United States Patent [19]

Kousens

[11] 4,392,697

[45] Jul. 12, 1983

[54] DRAWER STOP

[76] Inventor: William L. Kousens, 1736 Kadwell Way, El Cajon, Calif. 92021

[21] Appl. No.: 234,882

[22] Filed: Feb. 17, 1981

[51] Int. Cl.[3] ..... A47B 88/00

[52] U.S. Cl. ..... 312/348; 312/333; 16/82

[58] Field of Search ..... 312/348, 333, 342 R, 312/274, 140; 16/82; 160/368 R, 369; 292/87

[56] References Cited

U.S. PATENT DOCUMENTS

| | | | |
|---|---|---|---|
| 441,308 | 11/1890 | Kenney | 312/348 |
| 442,496 | 12/1890 | Stone | 16/82 |
| 449,482 | 3/1891 | Levy | 312/348 |
| 1,161,633 | 11/1915 | Dirlam et al. | 312/348 |
| 1,388,851 | 8/1921 | Cordes | 16/82 |
| 2,097,480 | 11/1937 | Visser | 312/333 |
| 2,337,079 | 12/1943 | Balkind | 312/348 |
| 2,765,208 | 10/1956 | Bush | 312/348 |
| 3,138,416 | 6/1964 | Abramovich | 312/348 |
| 3,397,001 | 8/1968 | Friedman | 312/348 |
| 3,639,028 | 2/1972 | Black | 16/82 |

*Primary Examiner*—Victor N. Sakran
*Attorney, Agent, or Firm*—Brown & Martin

[57] ABSTRACT

An elongated substantially flat body has longitudinal rounded bosses extending from one side thereof, and an opening in the flat body accommodates the shank of a screw for affixing the body to a drawer, the longitudinal bosses contacting the drawer surface when the body is attached, the flat portion of the body being spaced from the drawer surface, whereby said bosses accommodate rotation of the body around the screw shank between the operative and inoperative positions without binding and without loosening the screw from the drawer.

2 Claims, 5 Drawing Figures

DRAWER STOP

BACKGROUND OF THE INVENTION

A drawer stop is normally affixed to the inside surface of the back portion of the drawer to keep the drawer from accidentally being completely removed from the drawer tracks and the drawer jamb. The drawer stop is affixed to the drawer with a screw or bolt extending through an opening near one end of the drawer stop so that the drawer stop can be rotated between its vertical operative position and a substantially horizontal inoperative position. When the drawer stop is vertical it engages the top of the drawer jamb to prevent the drawer from accidentally being pulled off the tracks and free of the jamb. When it is desired to remove the drawer, the drawer stop is rotated about the screw or bolt to a position below the top of the drawer jamb. In this position the drawer can be removed from the drawer jamb.

Conventional drawer stops are flat and are screwed down into position to keep them from accidentally rotating. When the drawer stop is fastened into position with a snug fit, the flat surface of the drawer stop and the flat surface of the drawer cause the drawer stop to bind. The drawer cannot then be removed from the drawer tracks and the drawer jamb without loosening the fastener. If the drawer stop is affixed to the drawer in a looser fashion to provide play, the drawer stop tends to rotate from its own weight to the inoperative position. The drawer will then come completely out of the tracks and past the drawer jamb. This results in the drawer falling to the floor with potential damage to the drawer and injury to the person removing the drawer. If the drawer contains business files, the files fall loose from the drawer spilling the contents and causing a time consuming and aggravating problem. A person or company which utilizes a large number of drawers does not continually monitor the screw pressure of the drawer because this is not considered a normal maintenance task.

SUMMARY OF THE INVENTION

An exemplary embodiment of the invention overcomes the deficiencies of the prior art by providing a drawer stop with a substantially flat elongated body having a pair of elongated, curved, resilient boss means for engaging the surface of the drawer to which the drawer stop is attached, and including fastening means near one end of said body whereby said body is affixed to the drawer surface with only the bosses in contact with said surface so that said drawer stop does not bind against the drawer when it is rotated about the fastening means between the operative and inoperative positions.

DETAILED DESCRIPTION OF THE INVENTION

Figure 1:
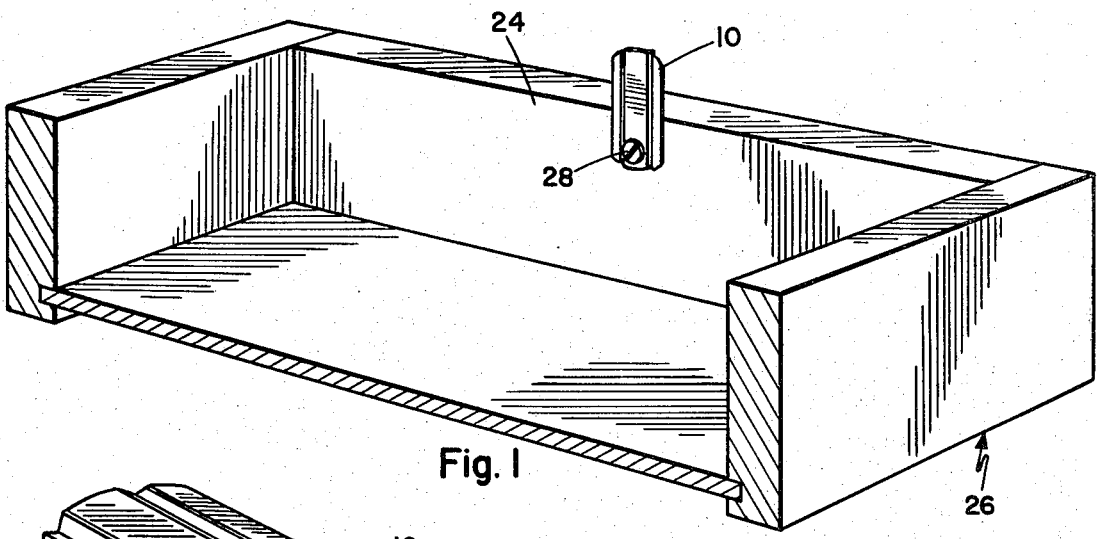
FIG. 1 is a perspective view of a portion of a drawer showing the drawer stop fastened in place in the vertical or operative position.
Figure 2:
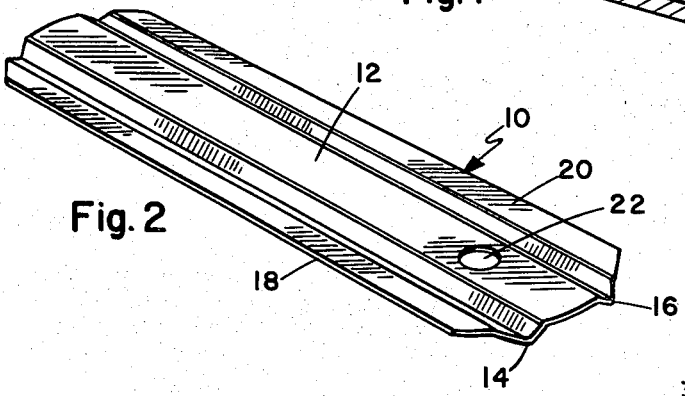
FIG. 2 is an enlarged perspective view of the drawer stop.

Referring to FIGS. 1–4 of the drawings, a drawer stop is shown at 10. The drawer stop comprises the substantially flat body 12 which has a pair of elongated curved bosses 14 and 16 formed therein. The bosses must not be pointed or they will bind. If they provide a high degree of surface contact they will also bind. The drawer stop 10 is formed of a suitable material which is relatively stiff but which affords some resilience in the elongated bosses. Several different materials can be used and a heat treated cadmium plated alloy steel is an example of an acceptable material. The end portions 18 and 20 extend from the longitudinal bosses 14 and 16. A hole 22 is formed in the body 12 near one end to provide means for fixing the drawer stop in position in a drawer. FIG. 1 shows the door stop of the present invention secured in place on the back panel 24 of a drawer 26. The drawer stop 10 is connected in position by a threaded member 28. Wood screws or steel screws can be used depending upon the drawer material, or the drawer stop can be secured by a bolt extending through the back panel 24 with a nut, Tinnerman fastener, or the like secured to the end of the bolt. When the threaded member 28 is secured to the back panel 24, the elongated bosses 14 and 16 engage the surface 24 of the back panel with their curved portions against the back panel. The curvature of the bosses and resilience of the bosses permits the threaded member 28 to be snuggly engaged into the back panel 24 without creating binding forces when the drawer stop is rotated about the threaded member 28.

Figure 3:
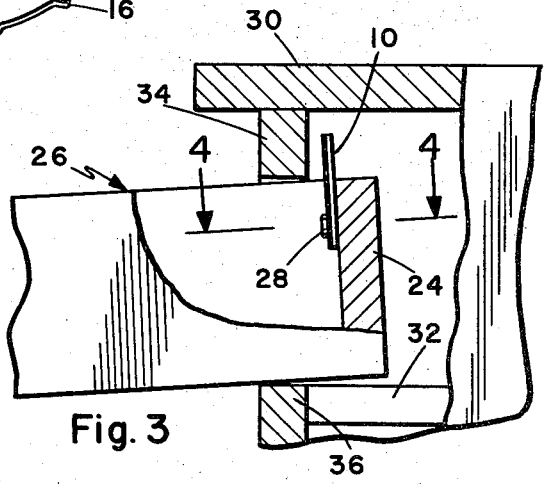
FIG. 3 is a side elevation of a drawer receptacle and a drawer positioned in the receptacle with portions broken away to reveal the internal construction.
Figure 4:
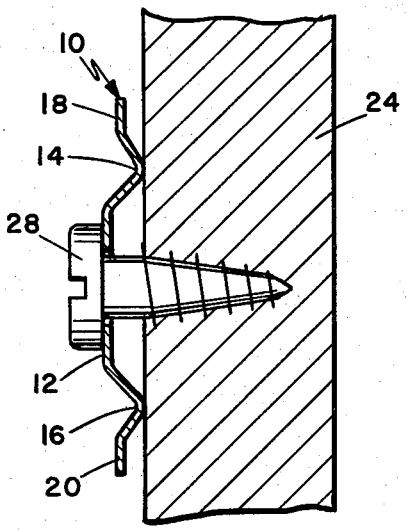
FIG. 4 is a sectional view taken along the line 4—4 of FIG. 3.

FIG. 3 shows the drawer stop of the present invention secured to a drawer positioned in a drawer receptacle 30. The bottom of the drawer 26 is slidably engaged with typical drawer tracks 32 provided in the receptacle structure. The receptacle 30 also includes an upper drawer jamb 34 which extends downward and a lower drawer jamb 36 which extends upward. When the drawer 26 is pulled out to the left as shown in the drawing, the vertical drawer stop 10 engages the upper drawer jamb 34 to prevent the drawer from being pulled completely out of the receptacle. When it is desired to intentionally remove the drawer 26 from the receptacle 30, the user merely grasps the drawer stop 10 and rotates it about the threaded member 28 toward the horizontal position so that the upper end of the drawer stop 10 will be lower than the upper door jamb 24. The drawer may now be completely removed from the receptacle. The drawer stop 10 is snuggly secured to the drawer so that it will not work loose from repeated rotation of the drawer stop between the operative and inoperative positions as drawers are removed. The drawer stop may be snuggly engaged with the drawer surface because the only contact with the drawer surface is through the curved resilient bosses 14 and 16. This limited, resilient contact makes it possible to repeatedly rotate the drawer stop without creating the dangerous condition of a loose drawer stop and without requiring a continual monitoring of the drawer stop to make certain that it has not worked loose.

Figure 5:
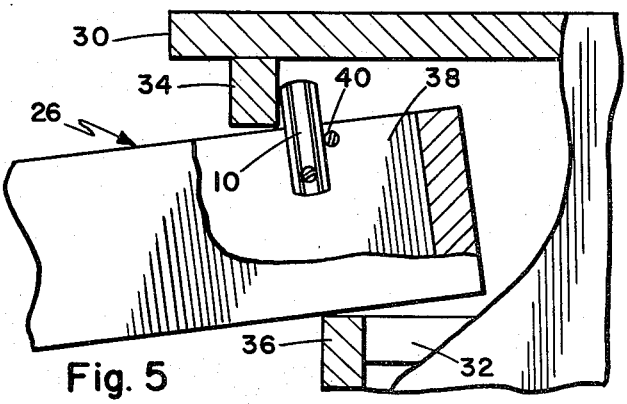
FIG. 5 is a side elevation of a drawer installation partially cut away to show the drawer stop positioned on the side of the drawer rather than the back.

FIG. 5 of the drawing shows the drawer stop of the present invention secured to the side panel 38 of the drawer 26. This embodiment is particularly useful in drawer constructions which have a loose fit in the drawer receptacle. As the drawer is moved out of the drawer receptacle, it tends to slant as shown in FIG. 5 of the drawings. If clearance is excessive and the drawer stop is positioned at the back of the drawer, it could pass below the upper drawer jamb. The drawer stop of the present invention is positioned on the side panel 38 of the drawer toward the front of the drawer from the back panel 24. This enables a drawer stop to be positioned where it will engage the upper drawer jamb, even when the drawer has a sloppy fit in the drawer enclosure. In this modification, a stop 40 is positioned in the side panel 38 of drawer 26 rearward of the drawer stop 10. Thus, as the drawer stop 10 engages the upper drawer jamb of an enclosure, it cannot be rotated clockwise in the drawing to a position which will enable the drawer to be accidentally removed completely from the door enclosure. The stop may be any suitable device such as a threaded member fixed to the side panel 38 of the drawer. The drawer stop 10 is affixed in position with its pivot point at the threaded member 28 below the stop 40 so that the drawer stop may be rotated counter clockwise to move it to the inoperative or drawer removal position.

The drawer stop of the present invention may be made as a simple inexpensive stamping which results in an effective and low cost device.

I claim:

1. A one piece drawer stop for preventing accidental removal of a drawer from a drawer receptacle, comprising:

a substantially flat body of relatively stiff material with some resiliency, including a pair of elongated curved bosses extending longitudinally of said body near the outer edges thereof, and along the entire length of said body;

an opening in said body between said bosses near one end thereof for receiving a fastener to secure the drawer stop to said drawer and provide a pivot axis for said drawer stop;

said drawer stop being rotatable about said axis with only the curved portions of said bosses engaging the drawer surface whereby said drawer stop can be snuggly affixed to said drawer without loosening said drawer stop when it is rotated between the operative drawer stopping position and the inoperative drawer removal position.

2. A one piece drawer stop according to claim 1 including stop pin means for positioning on the side of a drawer above the pivotal axis of said drawer stop and for eliminating movement of the drawer stop in one direction of rotation.

* * * * *